United States Patent [19]

Ferlazzo et al.

[11] Patent Number: 4,805,911

[45] Date of Patent: Feb. 21, 1989

[54] GOLF CLUB STAND HIDABLE IN HANDLE

[76] Inventors: Anthony P. Ferlazzo, 267 6th St., West, Bonita Springs, Fla. 33923; Samuel J. Rapaport, 725 Parkview La., Naples, Fla. 33940

[21] Appl. No.: 68,478

[22] Filed: Jul. 1, 1987

[51] Int. Cl.[4] ..... H63B 55/10

[52] U.S. Cl. ..... 273/162 R; 273/32 R

[58] Field of Search ..... 273/77 R, 77 A, 81 R, 273/81 B, 81 C, 80 R, 80 D, 32 R, 32 B, 32 E, 32 D, 162 R, 162 F, 163 R, 163 A, 162 B, 162 E, 194 R, 194 B; 211/70.2

[56] References Cited

U.S. PATENT DOCUMENTS

| | | | |
|---|---|---|---|
| 3,185,146 | 5/1965 | Leopoldi | 273/162 F |
| 3,456,737 | 7/1969 | Rhyme | 273/162 F |
| 3,771,794 | 11/1973 | Crockett | 273/162 R |
| 3,774,913 | 11/1973 | Dien | 273/32 R |
| 4,210,334 | 7/1980 | Lind | 273/163 R |
| 4,384,719 | 5/1983 | Schmanski | 273/194 R |
| 4,545,579 | 10/1985 | McCain | 273/162 R |

*Primary Examiner*—Richard C. Pinkham
*Assistant Examiner*—William E. Stoll
*Attorney, Agent, or Firm*—John Cyril Malloy

[57] ABSTRACT

In one embodiment, the golf club stand includes an elongated member having a stand section that is hinged at one end to a support section, both sections comprising the elongated member and being substantially disposed within the golf club handle when the stand is in an inoperative mode of operation. At the other end of the stand section is a stand head that is adjacent to terminal end surface of the golf club handle grip when the stand is in the inoperable mode. An interface coupling is mounted to the terminal end of the grip. The coupling has a through passage within which is slidably disposed the stand section. In an operative mode, the hinged end of the stand section is disposed outside the grip of the golf club and the stand section rotates in a plane normal to the plane of the golf club head. The support section substantially remains within the golf club handle during this standing mode of operation. To lock the elongated member within the golf club handle, a finger extends from the inboard end of the interface coupling and mates with a depression on the stand section when the elongated member is in the inoperative mode. To prohibit the elongated member from being totally withdrawn from the golf club handle, the finger sets within a stop slot at the end of the support section when the elongated member is in the operative standing mode.

7 Claims, 1 Drawing Sheet

GOLF CLUB STAND HIDABLE IN HANDLE

BACKGROUND OF THE INVENTION

The present invention relates to a golf club stand which, in one mode of operation, hides within the grip handle of a golf club and, in another mode of operation, extends outward and swings such that the golf club handle rests the stand above the ground.

One prior art device is disclosed in U.S. Pat. No. 4,210,334 and basically includes a clip-on clamp that attaches to an outer portion of the golf club shaft and includes a rotatable stand section that is mounted onto the clamp. In the collapsed mode, the longitudinal axis of the stand is generally parallel with the longitudinal axis of the golf club shaft; in the standing mode, the axis of the stand is normal to the axis of the golf club. Another prior art device is disclosed in U.S. Pat. No. 4,545,579 to McCain. This prior art stand also includes a clamp that is mounted to the outside of the golf club shaft and a rotatable stand that is rotatably mounted to the clamp. The stand however is conically shaped hollow sleeve that partially wraps around the club shaft. Other patents have described items that can be placed in the handles of golf clubs. For example, U.S. Pat. No. 3,771,794 to Crockett discloses a turf repair implement that is mounted in the handle of the club. U.S. Pat. No. 3,774,913 discloses a green fixing tool and ball marker that is mounted in the terminal end of the handle grip of a golf club.

OBJECTS OF THE INVENTION

It is an object of the present invention to provide a golf club stand that is completely disposed within the handle of a golf club when the stand is not in use and which protrudes from the terminal end of the handle grip when the stand is in use.

It is another object of the present invention to provide a stand that maintains the balance of the golf club due to the stand's disposition in the handle with respect to the longitudinal center line of the club.

It is a further object of the present invention to provide a golf club stand that is easily installed in an existing golf club.

It is an additional object of the present invention to provide a golf club stand which locks in a first inoperative mode, and is releasable from that locked position in a standing mode.

SUMMARY OF THE INVENTION

In one embodiment, the golf club stand includes an elongated member having a stand section that is hinged at one end to a support section, both sections comprising the elongated member and being substantially disposed within the golf club handle when the stand is in an inoperative mode of operation. At the other end of the stand section is a stand head that is adjacent to a terminal end surface of the golf club handle grip when the stand is in the inoperable mode. An interface coupling is mounted to the terminal end of the grip of the golf club. The coupling has a through passage within which is slidably disposed the stand section. In an operative mode, the hinged end of the stand section is disposed outside of the grip terminal end of the golf club and the stand section rotates in a plane normal to the plane of the golf club head. The support section substantially remains within the golf club handle and is partially supported by the interface coupling during the standing mode of operation. To lock the elongated member within the golf club handle, a finger extends from the inboard end of the interface coupling and mates with a depression on the stand section when the elongated member is in the inoperative mode. To prohibit the elongated member from being totally withdrawn from the golf club handle, the finger sets within a stop slot in the support section when the elongated member is in the operative standing mode.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a golf club stand that is hidable in the handle of a golf club.

Figure 1:
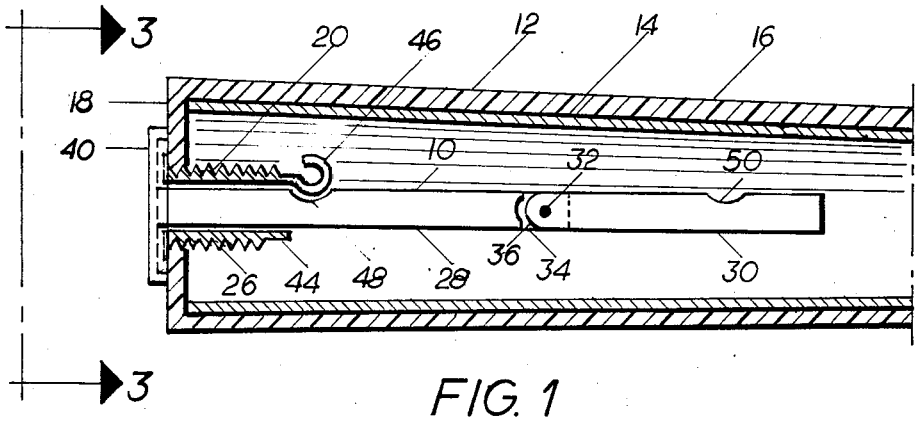
FIG. 1 illustrates a schematic view of the golf club stand in the inoperative or first mode of operation when the stand is disposed within the golf club handle.

FIG. 1 schematically shows golf club stand 10 in the first or inoperative mode of operation wherein the stand is substantially disposed within golf club handle 12. A golf club shaft 14 is covered with a handle grip 16 that has a terminal end 18. An interface coupling 20 is mounted in terminal end 18. Coupling 20 has male threads 22 which, in this embodiment, easily grip central region 24 of terminal end 18. Coupling 20 has a through passage 26 through which is slidably disposed an elongated member made up of stand section 28 and support section 30.

Stand section 28 is hinged to support section 30 at pivot point 32. In this embodiment, joint 34 between stand section 28 and support section 30 is a tongue and yoke where the tongue extends from stand section 28 and the yoke extends from support section 30. The end of the yoke is curved along surface 36 and that curve has a mating seat 38 formed into the hinged end region of stand section 28. This insures that support section 30 is longitudinally and axially aligned with stand section 28 while in the inoperative mode.

At the other end of stand section 28 is a stand head 40. In the operative mode, head 40 is adjacent terminal end 18 of golf club handle 12. Coupling 22 longitudinally extends inboard from the terminal end 18 into the interior space 42 of golf club handle 12. Mounted along the inboard section 44 of coupling 20 is a finger 46. In one embodiment, finger 46 is a flexible spring steel member that is biased towards the elongated member.

When golf club stand 10 is in the inoperative or fully hidden mode, finger 46 rests within depression 48 on one surface of stand section 28. This provides a releasable locking mechanism that maintains the positioning of golf club stand 10 within handle 12 of the golf club. The elongated supporting action of coupling 20, the locking feature of finger 46 and depression 48, and the locking feature of surface 36 and seat 38 enables golf club stand 10 to be maintained generally coaxial with the longitudinal center line of the golf club. This maintains the balance of the club during the swing by the golfer.

Figure 2:
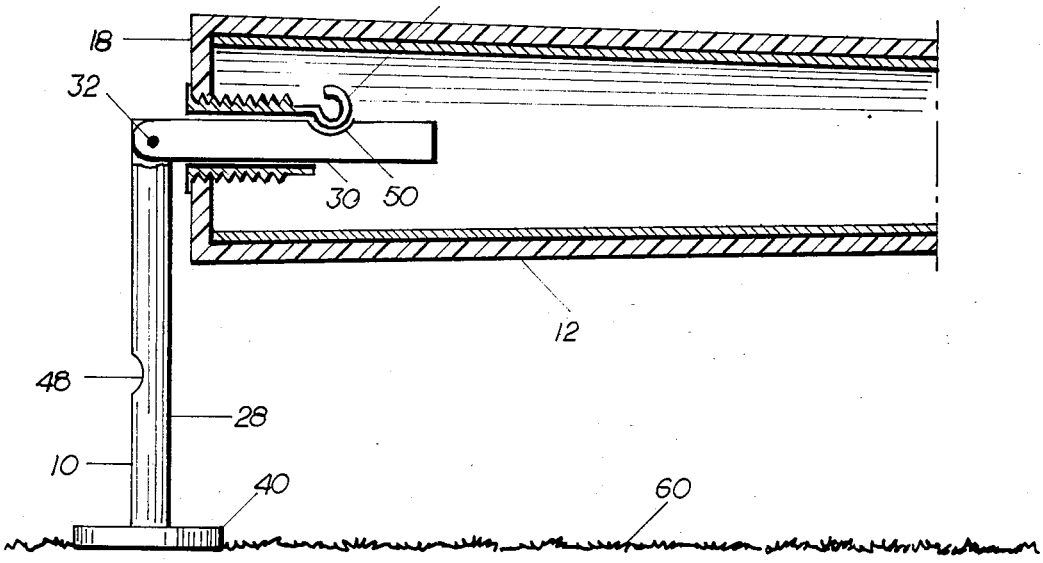
FIG. 2 illustrates the golf club stand in the second or standing mode of operation when the stand is supporting the golf club.

FIG. 2 shows the second mode of operation of golf club stand 10 or the standing mode of operation. The transition between the inoperative mode to the standing mode is accomplished by pulling golf club stand 10 in direction z shown in both FIGS. 1 and 2. The pulling action releases the locking action of finger 46 on depression 48 and the golf club stand moves axially outward along direction z until finger 46 sets within stop slot 50 that is near the inboard most end of support section 30. In the standing mode of operation, the operation of locking finger 46 and stop slot 50 prohibits the further extension of golf club stand 10 in direction z.

Stand section 28 rotates about the hinge at pivot 32 when finger 46 rests in stop slot 50. Therefore in the standing mode, the hinge between support section 30 and stand section 28 is proximate terminal end 18 of golf club handle 12.

In the standing mode of operation, golf club stand 10 raises golf club handle 12 a sufficient distance above ground 60 such that the handle does not become wet or dirty with dew, moisture, dirt or sand on ground 60.

Figure 3:
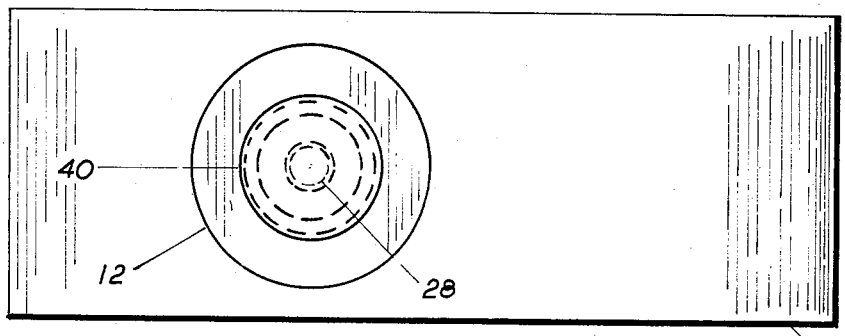
FIG. 3 illustrates an end view of the golf club handle with the stand in the inoperative mode; and, FIG. 4 schematically illustrates the golf club supported by the stand in the standing mode of operation.
Figure 4:
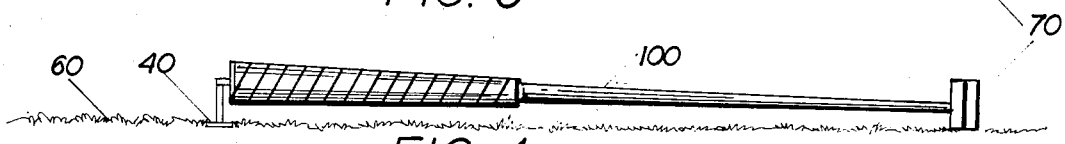

FIGS. 3 and 4 show the orientation of the golf club stand with respect to golf club face 70. Golf club face 70, in FIG. 3, is generally parallel to imaginary line x. A plane coplanar with golf club head 70 is normal to the plane passing through the longitudinal center line of the club handle 12. Stand section 28 rotates through that plane that passes through imaginary line y when that section rotates at hinge pivot 32 with respect to support section 30. In this manner, as shown in FIG. 4, golf club 100 is securely supported on stand head 40 and golf face 70.

The claims appended to this application are meant to cover modifications and changes within the scope and spirit of the present invention. For example, finger 46 can be substituted by a ball and socket fit between the coupling and stand section 28 as long as the ball is biased towards the stand section. Grip 16 could be manufactured to include interface coupling 20 and hence the male threads 22 on the coupling would not be necessary. In that case, the elongated support of coupling 20 would be necessary to mount the elongated member, comprising stand section 28 and support section 30, coaxially within golf club handle 12. Other types of stop mechanisms could be utilized at the inboard most end of support section 30. For example, a T section could be utilized that abuts the inboard most end of coupling 20 during the standing mode. These and other modifications and changes are meant to be encompassed by the appended claims.

What is claimed is:

1. A golf club stand hideable in a grip handle of a golf club and extendable from a terminal end of said grip handle, said golf club stand comprising:

an elongated member having a stand section that is hinged at one end to a support section, said stand section having a stand head at an opposite end from said hinged end of said stand section;

an interface coupling adapted to be mounted in a terminal end of a grip of a golf club, said coupling having a through passage within which is slideably disposed said stand section of said elongated member, said stand head adapted to be disposed proximate a grip terminal end in a first mode of operation of said golf club stand and said hinged end of said stand section adapted to be disposed proximate the grip terminal end in a second mode of operation;

means for releaseably locking said elongated member within the grip handle when in said first mode of operation, a hinged end of said support section protruding beyond the grip terminal end when disposed in said second mode of operation and a mid region of said support section being disposed within said through passage when the stand is in said second mode of operation; and means for prohibiting the further extension of said support section from said grip handle during said second mode of operation comprising a stopping means acting upon said interface coupling.

2. A golf club stand as claimed in claim 1 wherein said means for releasably locking is adapted to be entirely disposed within said grip handle.

3. A golf club stand as claimed in claim 2 wherein said means for releasably locking includes complimentarily shaped locking parts respectively disposed on said interface coupling and said stand section.

4. A golf club stand as claimed in claim 3 wherein said locking parts include a flexible finger protruding from said interface coupling and a depression on said stand section, the terminal end of said finger resting within said depression during said first mode of operation.

5. A golf club stand as claimed in claim 1 wherein the rotational movement of said stand section about the hinge is adapted to be in a plane normal to a face of said golf club.

6. A golf club stand hideable in a grip handle of a golf club and extendable from a terminal end of said grip handle, said golf club stand comprising:

an elongated member having a stand section that is hinged at one end to a support section, said stand section having a stand head at an opposite end from said hinged end of said stand section;

an interfaced coupling adapted to be mounted in a terminal end of a grip of a golf club, said coupling having a through passage within which is slideably disposed said stand section of said elongated member, said stand head adapted to be disposed proximate a grip terminal end in a first mode of operation of said golf club stand and said hinged end of said stand section adapted to be disposed proximate the grip terminal end in a second mode of operation;

means for releaseably locking said elongated member within the grip handle when in said first mode of operation comprising a flexible finger protruding from said interfaced coupling and a depression of said stand section, a terminal end of said finger resting within said depression during said first mode of operation, a hinged end of said support section protruding beyond the grip terminal end when disposed in said second mode of operation and a mid region of said support section being disposed within said through passage when the stand is in said second mode of operation, means for prohibiting the further extension of said support section from said grip handle during said second mode of operation comprising an end stop slot longitudinally aligned with said depression that coacts with said finger thereby prohibiting further extending movement of said elongated member.

7. A golf club stand as claimed in claim 6 wherein the rotational movement of said stand section about the hinge is adapted to be in a plane normal to a face of said golf club.

* * * * *